US008779871B2

(12) United States Patent
Juenemann et al.

(10) Patent No.: US 8,779,871 B2
(45) Date of Patent: Jul. 15, 2014

(54) FORWARD COUPLER WITH STRIP CONDUCTORS

(75) Inventors: Ralf Juenemann, Munich (DE); Alexander Bayer, Munich (DE); Michael Freissl, Munich (DE); Christian Evers, Heimstetten (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 227 days.

(21) Appl. No.: 13/125,487

(22) PCT Filed: May 14, 2010

(86) PCT No.: PCT/EP2010/002960

§ 371 (c)(1),
(2), (4) Date: Jun. 9, 2011

(87) PCT Pub. No.: WO2010/139392

PCT Pub. Date: Dec. 9, 2010

(65) Prior Publication Data

US 2012/0068786 A1 Mar. 22, 2012

(30) Foreign Application Priority Data

Jun. 4, 2009 (DE) ..... 10 2009 023 873
Oct. 2, 2009 (DE) ..... 10 2009 048 148

(51) Int. Cl.
*H01P 5/12* (2006.01)
*H01P 3/08* (2006.01)

(52) U.S. Cl.
USPC ..... 333/116; 333/109

(58) Field of Classification Search
USPC ..... 333/109, 110, 111, 112, 116, 117
See application file for complete search history.

(56) References Cited

U.S. PATENT DOCUMENTS 4,139,827 A * 2/1979 Russell ..... 333/116
4,737,740 A 4/1988 Millican et al.
7,183,877 B2 * 2/2007 Juenemann et al. ..... 333/116

FOREIGN PATENT DOCUMENTS

DE 4118399 C1 11/1992
EP 2045869 A1 4/2009
WO WO-2005064740 A1 7/2005

OTHER PUBLICATIONS

International Search Report for PCT/EP2010/002960 dated Jan. 10, 2010.

* cited by examiner

*Primary Examiner* — Dean O Takaoka
(74) *Attorney, Agent, or Firm* — Marshall, Gerstein & Borun LLP

(57) ABSTRACT

A coupler comprises a first line and a second line in each case with two connectors. The lines run in spatial proximity and are coupled. A first connector of the first line and a first connector of the second line are disposed in spatial proximity. A second connector of the first line and a second connector of the second line are disposed in spatial proximity. A signal does not couple or couples only with a high attenuation from the first connector of the first line to the first connector of the second line. The signal is split, in particular, at the design frequency, into largely identical parts to the second connector of the first line and the second connector of the second line. The first line and the second line in this context are strip conductors.

11 Claims, 2 Drawing Sheets

FORWARD COUPLER WITH STRIP CONDUCTORS

BACKGROUND OF THE INVENTION

1. Field of the Invention

The invention relates to a coupler, especially a forward coupler.

2. Related Technology

Electronic measuring instruments for microwave technology must generally be designed to provide a very broad bandwidth in order to cover all possible customer applications. For example, the lower frequency limit is about 10 MHz with an upper frequency limit, for example, about 60 GHz. The generation and processing of such a frequency range is split up internally into several meaningful sub-ranges. The sub-ranges must be combined with one another at the front panel connector. This can be achieved in many different ways. From the point of view of providing the lowest possible losses of level, 3 dB forward couplers have proved to be the best solution.

For example, U.S. Pat. No. 5,055,807 B1 discloses such a forward coupler. However, the disadvantage here is that the forward coupler disclosed incurs high manufacturing costs and, moreover, a connection of this coupler to other circuits is difficult.

SUMMARY OF THE INVENTION

The invention provides a coupler, which allows low manufacturing costs with simple connectivity to further circuit elements.

Accordingly, the invention provides a coupler with a first line and a second line in each case with two connectors, wherein the lines run in spatial proximity and are coupled, a first connector of the first line and a first connector of the second line are disposed in spatial proximity, a second connector of the first line and a second connector of the second line are disposed in spatial proximity, a signal from the first connector of the first line does not couple or couples only with a high attenuation to the first connector of the second line and is subdivided especially at a design frequency in largely equal parts between the second connector of the first line and the second connector of the second line, and the first line and the second line are strip conductors.

The coupler according to the invention comprises a first line and a second line with two connectors in each case. The lines run in spatial proximity and are coupled. A first connector of the first line and a first connector of the second line are disposed in spatial proximity. A second connector of the first line and a second connector of the second line are disposed in spatial proximity. A signal, which is fed into the first connector of the first line, is split especially at the design frequency into largely identical parts to the second connector of the first line and the second connector of the second line. The first connector of the first line and the first connector of the second line in this context are largely isolated from one another. The first line and the second line are strip conductors. Accordingly, only low manufacturing costs are incurred. Furthermore, a simple connection of the further switching elements is achieved in this manner.

The strip conductors are preferably guided by a dielectric of which the special form allows an optimum adjustment of the characteristic properties of the even mode and odd mode. Good mechanical stability is achieved in this manner.

The dielectric preferably provides first grooves on opposing sides. The strip lines are preferably guided in the first grooves. Accordingly, a further increase in mechanical stability is achieved. Furthermore, very accurately defined electromagnetic properties, which are simple to calculate, are achieved in this manner.

The first line and the second line advantageously provide a relatively larger width outside the first grooves than inside the grooves in each case. The dielectric advantageously provides recesses at entry points of the lines into the first grooves. In this manner, an adaptation of the wave impedance of the lines is achieved through compensation of the abrupt capacitive change of the cross section.

The coupler preferably provides a housing, wherein the dielectric is preferably attached between a first housing part and a second housing part by means of clamping. Accordingly, a further increase in mechanical stability is achieved with low manufacturing costs.

Two surfaces of the dielectric, by means of which it is clamped between the housing parts, each preferably provide a second groove. In this manner, a secure fixing of the dielectric between the housing parts is provided. In this manner, very accurately defined electromagnetic conditions are achieved at the edges of the lines.

The second grooves preferably run parallel to the first grooves. This achieves low manufacturing costs.

Through its form, the dielectric preferably generates different dielectric constants for the even mode and odd mode. Accordingly, the required behavior of the coupler is preferably achieved via the resulting difference between the phase velocities of the even mode and odd mode.

Through its form, the dielectric preferably generates identical surge impedances for the even mode and odd mode. In this manner, the reliable isolation of the connectors adjacent to one end of the coupler is achieved.

The lines are advantageously connected to a supply line at each of their connectors. In each case, a supply line of the first line and of the second line preferably provides a bend perpendicular to the course of the respective line. The bend of one of the supply lines is preferably disposed on the side of the first connectors. The bend of the other supply line is preferably disposed on the side of the second connectors. A coupling of the supply lines is avoided in this manner.

The lines are alternatively connected to a supply line at each of their connectors. All supply lines of the first line and/or of the second line alternatively provide a bend perpendicular to the course of the respective line. A coupling of the supply lines is avoided in this manner.

The dielectric preferably provides recesses at entry points of the lines into the grooves. This achieves a compensation of the stray capacity, which arises from the abrupt change in cross-section from the supply line to the strip conductor guided in the dielectric.

BRIEF DESCRIPTION OF THE DRAWINGS

The invention is described below by way of example with reference to the drawings, in which an advantageous exemplary embodiment of the invention is shown. The drawings show.

DETAILED DESCRIPTION

The structure and the functioning of various forms of the coupler according to the invention are shown with reference to FIGS. 1-4. The presentation and description of identical elements in similar drawings has not been repeated in some cases.

Figure 1:
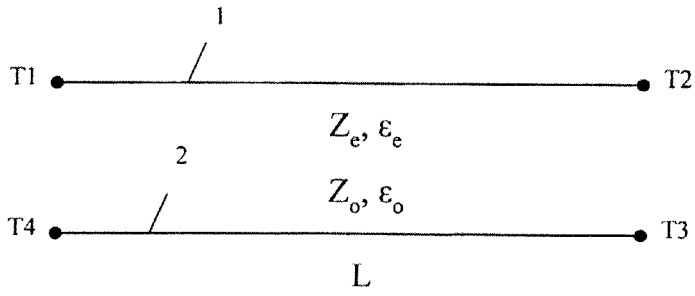
FIG. 1 a schematic presentation of the coupler according to the invention.

FIG. 1 shows a schematic presentation of the coupler according to the invention. A first line 1 provides the connectors T1 and T2. A second line 2 provides the connectors T4 and T3. The first line and the second line in this context are coupled to one another. The lines 1, 2 provide a length L. A dielectric, which is not illustrated here, is disposed between the lines 1, 2. In combination with the ambient air, the dielectric provides a wave impedance $Z_e$ for the even mode and a wave impedance $Z_o$ for the odd mode because of the field distribution. Furthermore, in combination with the ambient air, the dielectric has an effective dielectric constant $\in_e$ for the even mode, and an effective dielectric constant $\in_o$ for the odd mode. If the coupler is designed according to the invention, the lines 1, 2 are strip conductors.

With the coupler according to the invention, if a signal is supplied at the port T1, a uniform distribution of the power to the ports T2 and T3 is achieved with simultaneous isolation of the port T4 and matching of all ports. For this purpose, the condition $Z_e=Z_o=Z_o$ must first be fulfilled, wherein $Z_o$ corresponds to the wave impedance of the lines supplying the signal. Additionally, the effective dielectric constant must satisfy the condition $\in_e \neq \in_o$. The length L in this context should be chosen in such a manner that, especially for the desired design frequency, that is, the frequency at which the coupler splits a signal supplied at port 1 into largely identical parts to the ports 2 and 3, the phase differences between the even mode and odd mode over the running length L of the coupler is exactly 90°.

Figure 2:
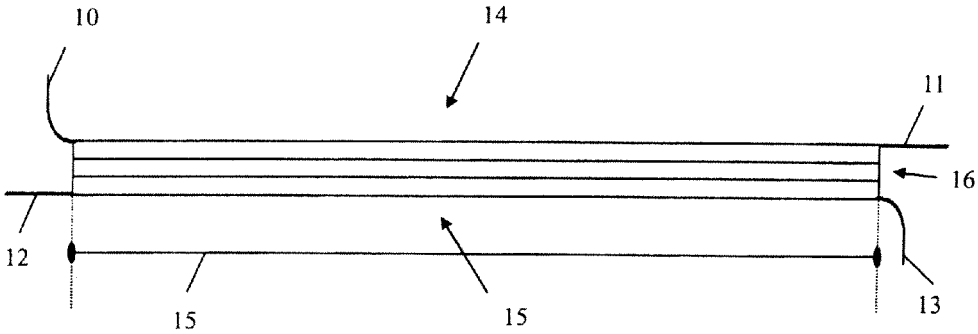
FIG. 2 a simplified exemplary embodiment of the coupler according to the invention.

FIG. 2 shows a simplified exemplary embodiment of the coupler according to the invention. Two lines 14, 15 are designed as strip conductors and guided in grooves of a dielectric 16. The lines 14, 15 in this context run along the surface of the dielectric 16. The lines 14, 15 preferably run in a largely parallel manner. The line 14 comprises the supply lines 10, 11. The line 15 comprises the supply lines 12, 13. The supply line 10 in this context is embodied with a 90° bend in order to avoid a coupling between the supply line 10 and the supply line 12. The supply line 13 is also designed with a 90° bend in order to avoid a coupling between the supply line 11 and the supply line 13.

Figure 3:
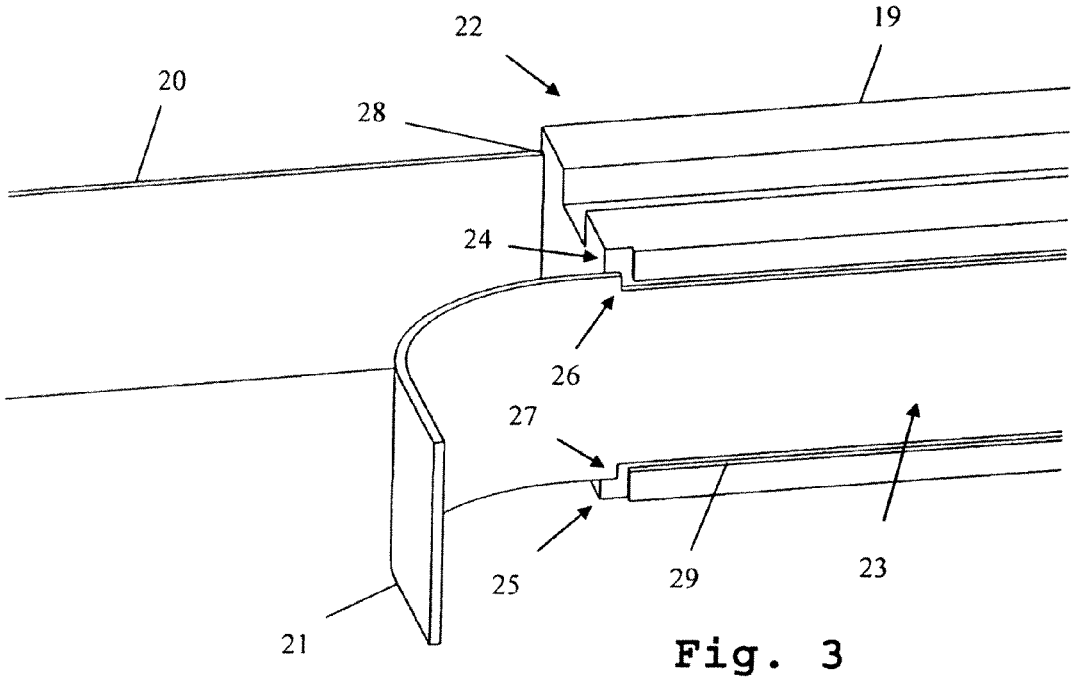
FIG. 3 a preferred exemplary embodiment of the coupler according to the invention.

FIG. 3 presents a preferred exemplary embodiment of the coupler according to the invention. The lines 22, 23 correspond to the lines 15, 14 from FIG. 2. The line 22 in this context extends not visible in this drawing on the back side of the dielectric 19 corresponding to the line 23. The supply line 20 of the line 22 in this context is designed as a straight line. The supply line 21 of the line 23 is designed with a 90° bend. The lines 22, 23 run in grooves 28, 29 of the dielectric 19. The grooves 28, 29 in this context are designed to be slightly wider than the lines 22, 23. The depth of the grooves 28, 29 preferably corresponds largely to the thickness of the lines 22, 23.

The supply lines 20, 21 are designed to be wider than the lines 22, 23 in order to achieve the wave impedance of 50 Ohm conventional in measurement technology. In order to compensate the abrupt change 26, 27 in width between the line 23 and the supply line 21, the dielectric 19 then provides recesses 24, 25 at the entry position of the supply line 21. The recesses 24, 25 in the dielectric 19 generate an inductance, thereby achieving a compensation of the capacitance arising through the abrupt change 26, 27 in the line width. Corresponding recesses in the dielectric are inserted at the interface between the supply line 20 and the line 22, but these have been omitted here for the sake of simplicity.

Figure 4:
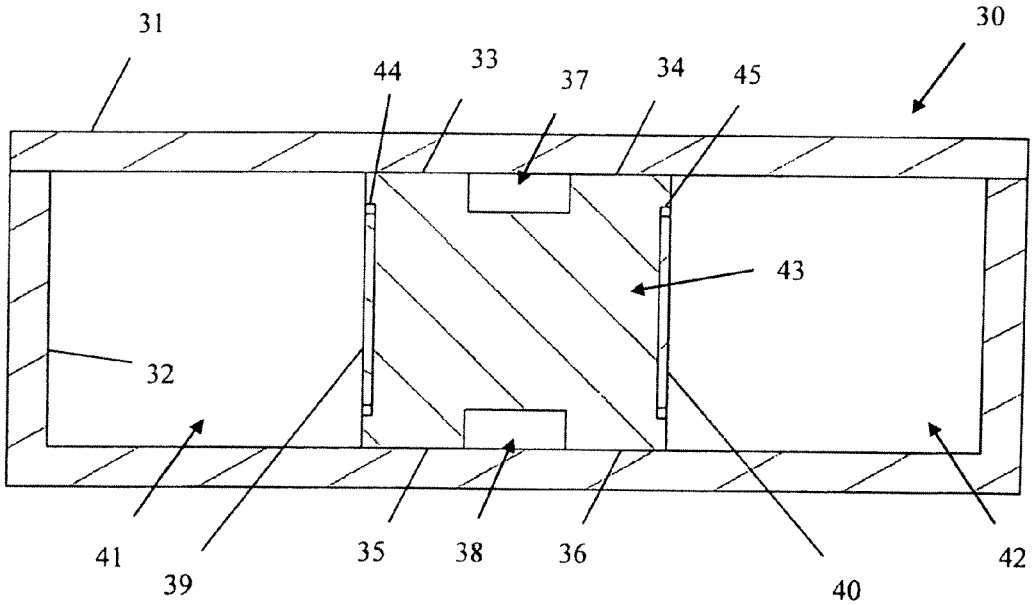
FIG. 4 a section through the preferred exemplary embodiment of the coupler according to the invention.

FIG. 4 shows a section through a preferred exemplary embodiment of the coupler according to the invention. This drawing shows a sectional view through the dielectric 43. The dielectric 43 provides first grooves 44, 45. The lines 39, 40 run in the first grooves 44, 45. The grooves 44, 45 in this context are designed to be slightly wider than the lines 39, 40. The lines 39, 40 are preferably attached in the grooves 44, 45 by gluing or clamping. Furthermore, the dielectric 43 provides second grooves 37, 38. No lines are guided in these grooves 37, 38. That is to say, only the ambient air is situated in the second grooves 37, 38.

The housing 30 comprises at least two housing parts 31, 32. The dielectric 43 is attached by clamping or gluing between the two housing parts 31, 32. Along the second grooves 37, 38, the dielectric 43 further provides ridges 33, 34, 35, 36. The two housing parts are each in contact with two steps 33, 34, 35, 36. The grooves 37, 38 ensure a reliable seating of the housing parts 31, 32 on the ridges 33, 34, 35, 36. Accordingly, defined conditions are achieved at the positions of maximum field strength, the upper and lower edges of the lines 39, 40.

In this context, the housing 30 is manufactured from a conductive material and preferably connected to ground. The housing 30 accordingly forms the counter electrode to the lines 39, 40.

The invention is not restricted to the exemplary embodiment presented. For example, an extremely diverse range of synthetic materials, which fulfill the named conditions, for example, polystyrene, can be used as the dielectric. All of the features described above or illustrated in the Figures can be advantageously combined with one another as required within the framework of the invention.

The invention claimed is:

1. A coupler with a first line and a second line in each case with two connectors, wherein:

the lines run in spatial proximity and are coupled, a first connector of the first line and a first connector of the second line are disposed in spatial proximity with respect to each other, a second connector of the first line and a second connector of the second line are disposed in spatial proximity with respect to each other, a signal from the first connector of the first line does not couple or couples only with a high attenuation to the first connector of the second line and is split at a design frequency in substantially equal parts between the second connector of the first line and the second connector of the second line;

the first line and the second line are strip conductors arranged on a dielectric;

the dielectric provides first grooves on opposing sides, and the strip conductors are guided in the first grooves.

2. The coupler according to claim 1, wherein the first line and the second line in each case provides a relatively larger width outside the first grooves than inside the grooves, and the dielectric provides recesses at entry points of the lines into the first grooves.

3. The coupler according to claim 1, wherein the coupler provides a housing and the dielectric is attached by clamping between a first housing part and a second housing part.

4. The coupler according to claim 3, wherein two surfaces of the dielectric, by which the dielectric is clamped between the housing parts each provide a second groove.

5. The coupler according to claim 4, wherein the second grooves run parallel to the first grooves.

6. The coupler according to claim 1, wherein the dielectric in combination with ambient air generates different, effective dielectric constants for an even mode and for an odd mode.

7. The coupler according to claim 1, wherein the lines are connected at each of their connections in each case to a supply line and in each case a supply line of the first line and a supply line of the second line provides a bend perpendicular to the course of the respective line.

8. The coupler according to claim 7, wherein the bend of one of the supply lines is disposed on the side of the first connectors, and the bend of the other supply line is disposed on the side of the second connectors.

9. The coupler according to claim 1, wherein the lines are connected at each of their connectors respectively to one supply line and all supply lines of the first line and/or of the second line provide a bend perpendicular to the course of the respective line.

10. The coupler according to claim 1, wherein the dielectric provides recesses at entry points of the lines into first grooves.

11. The coupler according to claim 1, wherein in combination with ambient air, the dielectric generates identical surge impedances for an even mode and for an odd mode, and said wave impedances correspond to a wave impedance of the supply lines.

* * * * *